US007340799B2

(12) United States Patent
Salice

(10) Patent No.: US 7,340,799 B2
(45) Date of Patent: Mar. 11, 2008

(54) ADAPTOR FOR A BRAKING DECELERATION DEVICE

(75) Inventor: Luciano Salice, Carimate (IT)

(73) Assignee: Arturo Salice S.p.A., Novedrate (Como) (IT)

( * ) Notice: Subject to any disclaimer, the term of this patent is extended or adjusted under 35 U.S.C. 154(b) by 0 days.

(21) Appl. No.: 10/822,387

(22) Filed: Apr. 12, 2004

(65) Prior Publication Data

US 2004/0200034 A1 Oct. 14, 2004

(30) Foreign Application Priority Data

Apr. 10, 2003 (DE) ..... 203 05 835 U

(51) Int. Cl.

| | |
|---|---|
| ***E05F 5/00*** | (2006.01) |
| ***E05F 5/02*** | (2006.01) |
| ***E05F 5/10*** | (2006.01) |
| ***E05F 7/04*** | (2006.01) |

(52) U.S. Cl. ..... 16/84; 16/54

(58) Field of Classification Search ..... 16/84, 16/86 R, 86 A, 86 B, 375, 54; 248/225.11, 248/225.21, 200; 312/333

See application file for complete search history.

(56) References Cited

U.S. PATENT DOCUMENTS

| | | | | |
|---|---|---|---|---|
| 1,013,762 | A | 1/1912 | Gibbs | |
| 1,464,448 | A | 8/1923 | Silberman | |
| 1,816,024 | A * | 7/1931 | Petersen | 16/85 |
| 2,074,008 | A * | 3/1937 | Wolf | 16/84 |
| 2,209,733 | A | 7/1940 | Jones | |
| 3,947,918 | A | 4/1976 | Favre et al. | |
| 4,196,924 | A * | 4/1980 | Iseki | 292/79 |
| 5,152,487 | A * | 10/1992 | Defatte et al. | 248/225.11 |
| 5,964,010 | A * | 10/1999 | Huber | 16/237 |
| 6,408,483 | B1 * | 6/2002 | Salice | 16/85 |
| 6,553,617 | B1 * | 4/2003 | Salice | 16/85 |
| 6,591,454 | B2 * | 7/2003 | Brustle | 16/374 |
| 6,684,453 | B2 * | 2/2004 | Wang | 16/54 |

FOREIGN PATENT DOCUMENTS

| | | |
|---|---|---|
| CN | 1114997 | 1/1996 |
| DE | 4016664 | 11/1991 |
| DE | 68901665 | 12/1992 |
| DE | 10159140 | 7/2002 |
| EP | 1006251 | 6/2000 |
| JP | 9273355 | 10/1997 |
| KR | 2000-35745 | 6/2000 |
| KR | 2000-47729 | 7/2000 |
| KR | 2000-62530 | 10/2000 |
| WO | 03/004817 | 1/2003 |

* cited by examiner

*Primary Examiner*—Robert J. Sandy
(74) *Attorney, Agent, or Firm*—Dilworth & Barrese LLP

(57) ABSTRACT

The invention relates to an adaptor for a braking deceleration device for doors or movable furniture parts, which essentially comprises a plunger which can be pushed into a housing against a braking force, with an adaptor body. According to the invention, the adaptor body comprises at least one accommodation recess for accommodating the housing of the braking deceleration device, and the adaptor body comprises suitable means by way of which it can be fixed to an attachment plate and via it to the frame or furniture carcass.

16 Claims, 3 Drawing Sheets

ADAPTOR FOR A BRAKING DECELERATION DEVICE

The invention relates to an adaptor for a braking deceleration device for doors or movable furniture parts, which essentially comprises a plunger which can be pushed into a housing against a braking force, with an adaptor body.

BACKGROUND OF THE INVENTION

From the European patent application EP 1 006 251 A1, braking deceleration devices are known which comprise a plunger which can be pushed into a housing or a cylinder against a braking force or damping force. The housing or cylinder is attached to the face of a frame or a furniture carcass by way of attachment means, with a particular arrangement of these attachment means, i.e. particular care during installation of the braking deceleration device, being necessary with the use of these attachment means. From DE 101 59 140 A it is known to design at least one of the hinges as a pure damping hinge without a closing device, wherein the damper is arranged in or on the hinge arm and/or in or on the hinge pot. The hinge arm, which can be anchored on a side wall of the piece of furniture by means of a base plate and preferably by means of an intermediate piece, is arranged such that it is held so that it is slidable in the depth of the piece of furniture. Installation of such integrated dampers is costly.

It is thus the object of the present invention to provide an adaptor for generic braking deceleration devices which can easily be attached to the furniture carcass.

SUMMARY OF THE INVENTION

According to the invention this object is met in that, in the adaptor body, at least one accommodation recess for accommodating the housing of the braking deceleration device is made, and in that the adaptor body comprises suitable means by way of which it can be fixed to an attachment plate and by way of this attachment plate to the frame of the furniture carcass. The invention is based on the idea of attaching or fixing the adaptor with the braking deceleration device accommodated in said adaptor to a normal installation plate for furniture fittings. Thus, the adaptor according to the invention comprises a recess or if appropriate a suitable seat for accommodating a normal braking deceleration device, for example a linear damper or a rotation damper with a protruding plunger. Furthermore, suitable means for attaching the adaptor or for the adaptor to click in on usual attachment plates are provided, preferably on installation plates for hinge arms. These means are designed such that the adaptors can be attached to the furniture carcass or the frame in the usual way, taking into account standardised attachment systems.

Preferred embodiments of the invention are disclosed herein.

Accordingly, it is preferably possible for the braking deceleration device to be attachable to the furniture side wall by means of the adaptor, with the hinges also being attached to said furniture side wall. Because of their short distance from the articulation axis of the door, the braking deceleration devices used in this arrangement contain a liquid with a viscosity of at least 15,000 cSt and particularly preferably at least 20,000 cSt.

According to a further advantageous embodiment, the attachment plate comprises a clip installation plate with projections for accommodating corresponding recesses in the adaptor body, lateral end stops and an end hook for engaging the projection in the adaptor body.

Preferably, the adaptor body can comprise recesses for engagement of corresponding projections of the clip installation plate and projections for engaging the hook.

Finally, the clip installation plate can consist of a base plate and an intermediate plate which is longitudinally slidable on said base plate. This adjustability of the installation plate in the depth of the piece of furniture makes it possible in an easy way to vary the stroke of the plunger, and thus the braking effect according to the thickness of the door and according to the adjustment of the hinges.

BRIEF DESCRIPTION OF THE DRAWINGS

Further characteristics, details and advantages of the invention are provided in the embodiments shown in the drawings.

The following are shown.

DESCRIPTION OF THE PREFERRED EMBODIMENTS

Figure 1:
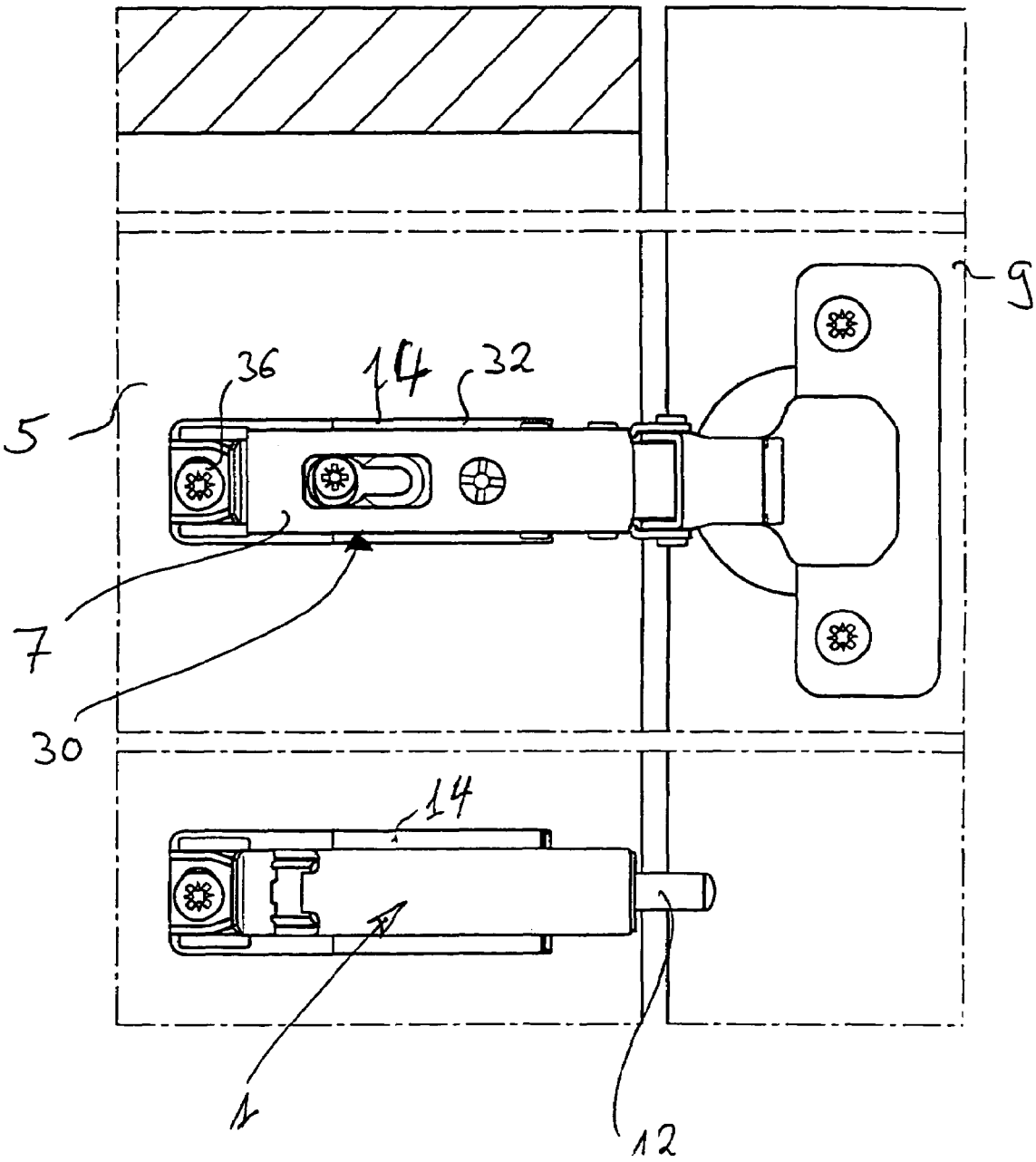
FIG. 1: a first embodiment of the adaptor according to the invention, in the installed state.

FIG. 1 shows a top view of the sidewall of a furniture carcass 5 and a door 9 in its open position, with said door 9 having been fastened in the normal way by way of a hinge 7.

Also attached to the sidewall of the piece of furniture is a braking deceleration device 1 according to the invention, on which braking deceleration device 1 the hinge 7 is arranged. Because of their short distance from the articulation axis of the door 9, the dampers 12 used in the braking deceleration device 1 can contain a damping liquid with a viscosity of at least 15,000 cSt.

Figure 2:
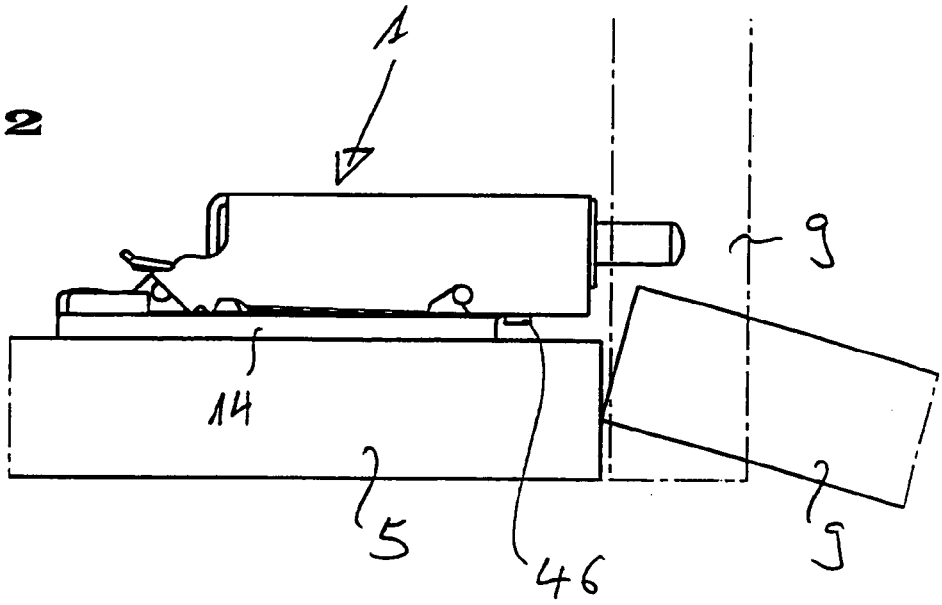
FIG. 2: a lateral view of the braking deceleration device according to FIG. 1.

FIG. 2 shows a lateral view of the braking deceleration device 1. The open position of the door 9 is indicated by a solid line while its closed position is shown by a dot-dash line.

Figure 3:
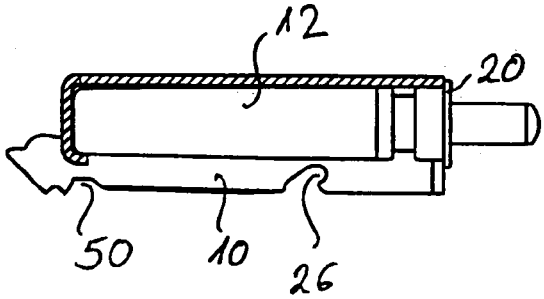
FIG. 3: a detail of the adaptor according to the invention, in an embodiment comprising a built-in braking deceleration device.
Figure 4:
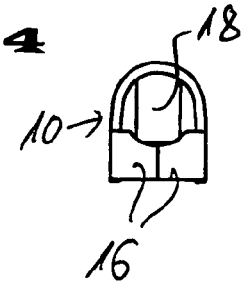
FIGS. 4 and 5: a front view and partial section view of the adaptor housing according to the embodiment variant shown in FIG. 3.
Figure 5:
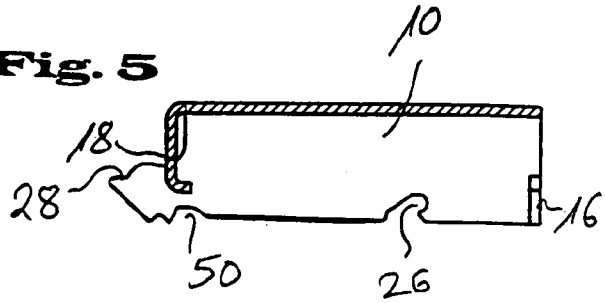

FIG. 3 shows a longitudinal section of the adaptor body 10 with integrated damper 12. The longitudinal section according to FIG. 5 shows front tabs 16 in the adaptor body 10 as well as a rear web 18, arranged at an angle, with the damper 12 (compare FIG. 3) resting against said web 18. As shown in FIG. 4, the front tabs 16 are rounded and form an end stop for a flange 20 provided on the damper 12.

Figure 6:
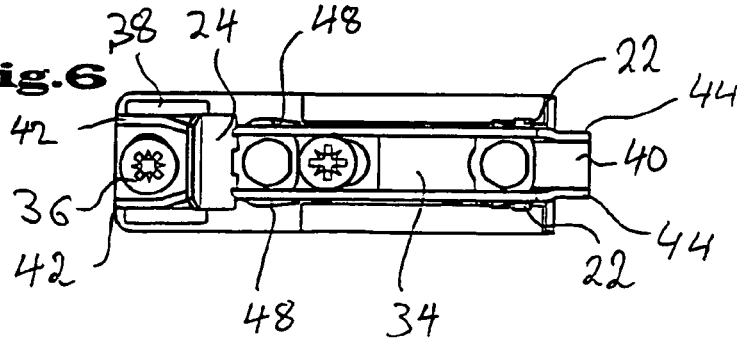
FIG. 6: a top view of a clip installation plate according to FIG. 2 without adaptor.

The adaptor body 10 comprises means for its attachment to a usual clip installation plate 14. In the embodiment shown, a clip installation plate 14 according to FIG. 6 has been used, with said clip installation plate 14 comprising front hanging gudgeons 22, lateral end stops 48 and a rear hook 24, each for recesses 26, 50 and projections 28 in the sidewalls of the adaptor body 10. The same means are also used to anchor the hinge arm 30 to a base plate 32 and to an intermediate plate 34 guided on said base plate 32 so as to be longitudinally slidable, with said intermediate plate 34 carrying the rear hook 24 and the front hanging gudgeon 22, wherein the sliding movement is effected by an eccentric 36.

Furthermore, for guidance of the intermediate plate 34 and the base plate 32, the latter comprises elevations 38 and a projection 40 which in each instance encompass, or fill in, angled side-walls 42 of the intermediate plate 34, with the sidewalls 44 being connected by a lower web 46 as shown in FIG. 2.

In principle it is however also possible to use clip installation plates of a different design in the context of the present invention. For example, the clip installation plate known from DE 40 16 664 A can be used. Adjustability of the installation plate in the depth of the piece of furniture makes it possible to vary the stroke of the plunger and thus the braking effect according to the thickness of the door and the adjustment of the hinges.

Figure 7:
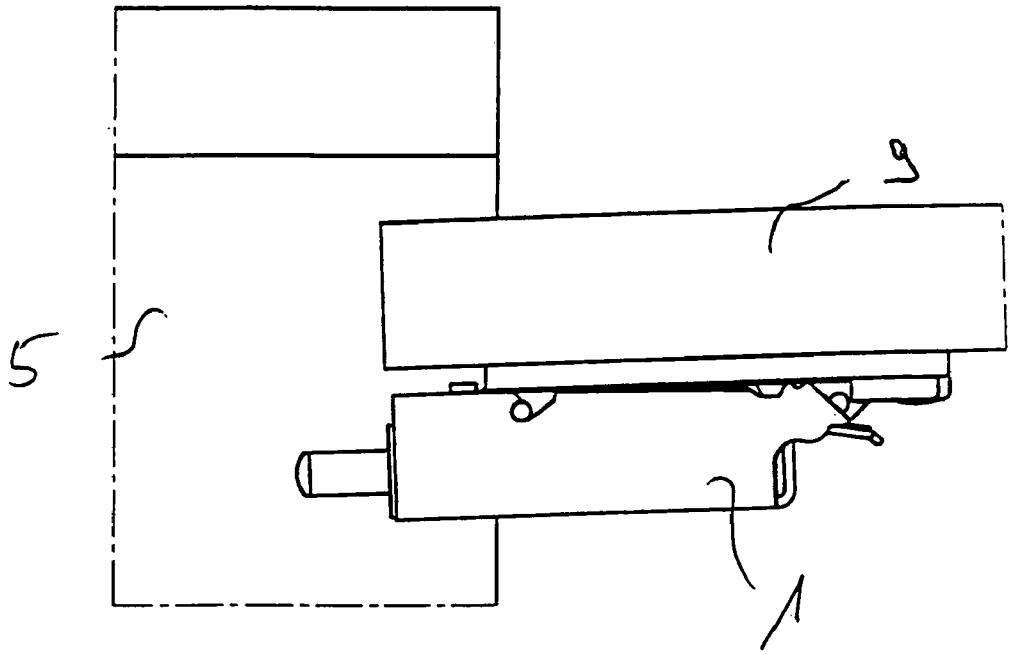
FIGS. 7 and 8: installed adaptors in further installation situations.
Figure 8:
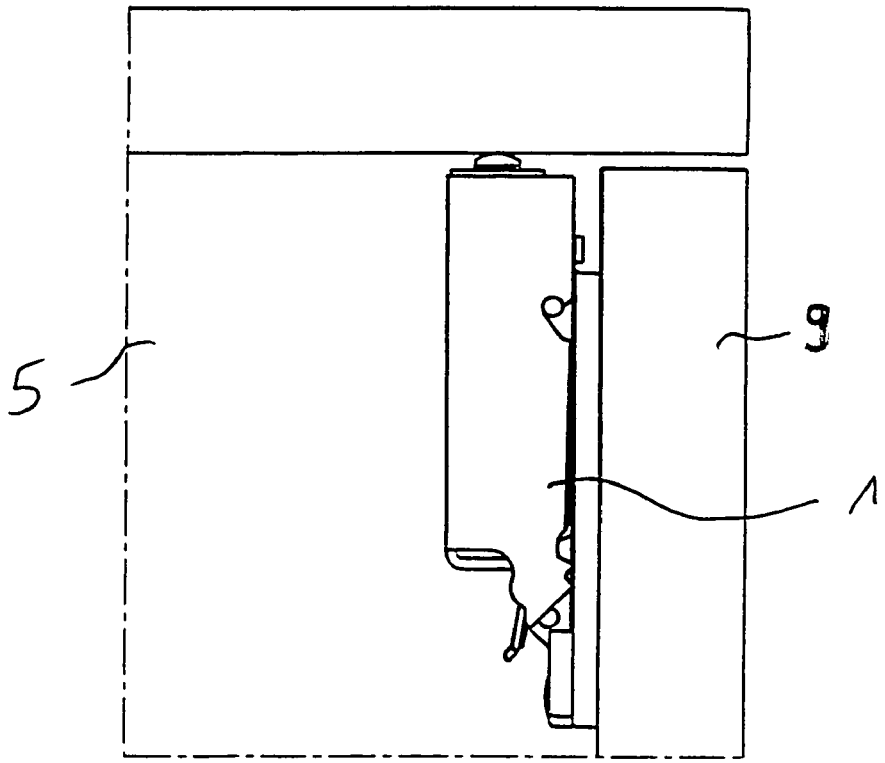

FIGS. 7 and 8 show that the adaptor according to the invention with the braking deceleration device can also be arranged on the inside of a door or of a flap 8.

The invention claimed is:

1. A combination for braking deceleration of a door or flap (9) pivotally mounted upon a furniture frame or carcass (5), said combination comprising, a braking deceleration device (1), an adaptor for the braking deceleration device (1), and an attachment plate (14), wherein said braking deceleration device (1) comprises a plunger (12) structured and arranged to be pushed into a housing against a braking force, said adaptor comprises an adaptor body (10), in turn, having a recess structured and arranged to encompass the housing of the braking deceleration device (1)and allow the plunger (12) to extend therefrom or retract thereinto, and a smooth external surface structured and arranged to be fixed to the attachment plate (14) and via the attachment plate (14) to the furniture frame or carcass (5), said adaptor is mounted separate and apart from a hinge (7) pivotally interconnecting the furniture frame or carcass (5) and door or flap (9), with said adaptor spaced from the hinge (7) in a direction along a rotating axis of the hinge (7), and said combination arranged such that the plunger (12)is pressed into the housing of said braking deceleration device (1) upon closing of the door or flap (9) against the furniture frame or carcass (5).

2. The combination according to claim 1, wherein the attachment plate comprises a clip installation plate (14) with first projections (22) for accommodating corresponding first recesses (26,50) in the adaptor body (10), lateral end stops (48) and an end hook (24) for engaging second projections (28) in the adaptor body (10).

3. The combination according to claim 2, wherein the clip installation plate (14) comprises a base plate (32) and an intermediate plate (34) which is longitudinally slidable on said base plate (32).

4. The combination according to claim 1, additionally comprising damping liquid having viscosity of at least 15,000 cSt.

5. The combination according to claim 4, wherein the viscosity of the damping liquid is at least 20,000 cSt.

6. The combination according to claim 2, wherein the adaptor body (10) additionally comprises second recesses (26,50) for engagement of the corresponding first projections (22) of the clip installation plate (14).

7. The combination according to claim 6, wherein the clip installation plate (14) comprises a base plate (32) and an intermediate plate (34) which is longitudinally slidable on said base plate (32).

8. The combination of claim 1, wherein the plunger (12)is arranged to move in a direction substantially normal to the rotating axis of the hinge (7).

9. A combination for braking deceleration of a door or flap (9) pivotally mounted upon a furniture frame or carcass (5), said combination comprising, a braking deceleration device (1), an adaptor for the braking deceleration device (1), and an attachment plate (14), wherein said braking deceleration device (1) comprising a plunger (12) structured and arranged to be pushed into a housing against a braking force, said adaptor comprises an adaptor body (10), in turn, having a recess structured and arranged to encompass the housing of the braking deceleration device (1) and allow the plunger (12) to extend therefrom or retract thereinto, and a smooth external surface structured and arranged to be fixed to the attachment plate (14) and via the attachment plate (14) to the door or flap (9), said adaptor is mounted separate and apart from a hinge (7) pivotally interconnecting the furniture frame or carcass (5) and door or flap (9), with said adaptor spaced from the hinge (7) in a direction along a rotating axis of the hinge (7), and said combination arranged such that the plunger (12) is pressed into the housing of said braking deceleration device (1) upon closing of the door or flap (9) against the furniture frame or carcass (5).

10. The combination of claim 9, wherein the plunger (12) is arranged to move in a direction substantially normal to the rotating axis of the hinge (7).

11. The combination according to claim 9, wherein the attachment plate comprises a clip installation plate (14) with first projections (22) for accommodating corresponding first recesses (26,50) in the adaptor body (10), lateral end stops (48) and an end hook (24) for engaging second projections (28) in the adaptor body (10).

12. The combination according to claim 9, additionally comprising damping liquid having viscosity of at least 15,000 cSt.

13. The combination according to claim 11, wherein the adaptor body (10) additionally comprises second recesses (26,50) for engagement of the corresponding first projections (22) of the clip installation plate (14).

14. The combination according to claim 12, wherein the viscosity of the damping liquid is at least 20,000 cSt.

15. The combination according to claim 11, wherein the clip installation plate (14)comprises a base plate (32) and an intermediate plate (34) which is longitudinally slidable on said base plate (32).

16. The combination according to claim 13, wherein the clip installation plate (14) comprises a base plate (32) and an intermediate plate (34) which is longitudinally slidable on said base plate (32).

* * * * *